United States Patent [19]

Helt et al.

[11] Patent Number: 4,986,786

[45] Date of Patent: Jan. 22, 1991

[54] GARMENT FOR USE IN WATER RECREATION

[76] Inventors: Dewey E. Helt; Johnann Helt, both of 4321 E. 74th Pl., Tulsa, Okla. 74136

[21] Appl. No.: 401,793

[22] Filed: Sep. 1, 1989

[51] Int. Cl.[5] ..... B63C 9/08

[52] U.S. Cl. ..... 441/120; 441/129

[58] Field of Search ..... 441/80, 81, 102, 106, 441/113, 114, 115, 120, 125, 126, 127, 129; D21/237, 238

[56] References Cited

U.S. PATENT DOCUMENTS

| | | | |
|---|---|---|---|
| D. 280,005 | 8/1985 | Jones | D21/238 |
| 1,803,095 | 4/1931 | Cole | 441/120 |
| 2,987,737 | 6/1961 | Brenner | 441/102 |
| 3,094,725 | 6/1963 | Martin, Jr. | 441/113 |

*Primary Examiner*—Sherman Basinger
*Assistant Examiner*—Jesus D. Sotelo
*Attorney, Agent, or Firm*—Head and Johnson

[57] ABSTRACT

A garment for use in water recreation in the form of a unitary flat member generally of a figure-8 construction having a front portion and a back portion, the portions being connected by a narrow crotch portion, the member being of soft, flexible and floatable material, such as closed cell foam plastic, and fasteners affixed to the front and back portions, the member being wearable by a user in which the crotch portion is positioned between the legs of the user and with the front portion in contact with the user's abdomen and the back portion in contract with the user's buttocks and lower back so that the garment floats the user in a generally upright or seated position.

3 Claims, 2 Drawing Sheets

GARMENT FOR USE IN WATER RECREATION

SUMMARY OF THE INVENTION

Various flotation devices have long been used for recreational purposes in a swimming pool, ocean, lake or other bodies of water. Such flotation devices have been in the form of inner tube shaped products in which the user's body extends through the inner tube with the inner tube supported under the arms of the users. Life jacket or vest-type devices have also been used, and others have provided trunk-shaped garments with flotation therein.

The present disclosure is to a simple, inexpensive and yet highly effective garment for use for recreation in the water. The garment is in the form of a unitary flat member, preferably formed of closed cell foam plastic so that the member is soft and flexible and highly floatable. Further, the member is preferably water impervious so that it drys rapidly when removed from the water.

The member is generally in the shape of a figure-8 having opposed first and second ends. The member has a first or front portion which has a first end and a back portion which has a second end. The portions are integrally connected by a narrow crotch portion.

Fastening members are secured to the front and back portions adjacent, respectively, the first and second ends of the member. The fastening members may be in the form of straps or webs affixed to the member such as by adhesive. The fastening members have free end portions. The fastening members have buckles, snaps or the like, or Velcro for attachment to each other.

The garment is worn by the user in which the crotch portion is positioned between the legs of the user and with the front portion in contact with the user's abdomen and the back portion in contact with the user's buttocks and lower back. When placed in such position, the garment is held in place by the fastening members.

With the garment in place, the user can enter water in a swimming pool, ocean, lake or the like and the flotation serves to comfortably support the user with the user's head safely above the top of the water, and with the user's arms completely free. Due to the configuration of the garment, the user is floated in a comfortable, relaxed, either upright or seated position so that the user is free to use his arms for paddling, or for playing water polo, or other games.

The garment is devised primarily for recreational and not for life saving, and is particularly adaptable for improving the comfort of flotation of a swimmer for recreation in water.

For background material relating to other flotation-type garments, references may be had to the following prior issued U.S. Pat. Nos. 2,490,556; 3,098,248; 1,730,812; 3,134,995; 3,144,668; 4,291,427; 3,681,800; 3,646,626.

A better understanding of the invention will be had by reference to the following description and claims, taken in conjunction with the attached drawings.

DESCRIPTION OF THE PREFERRED EMBODIMENT

Figures 2, 3, 4:
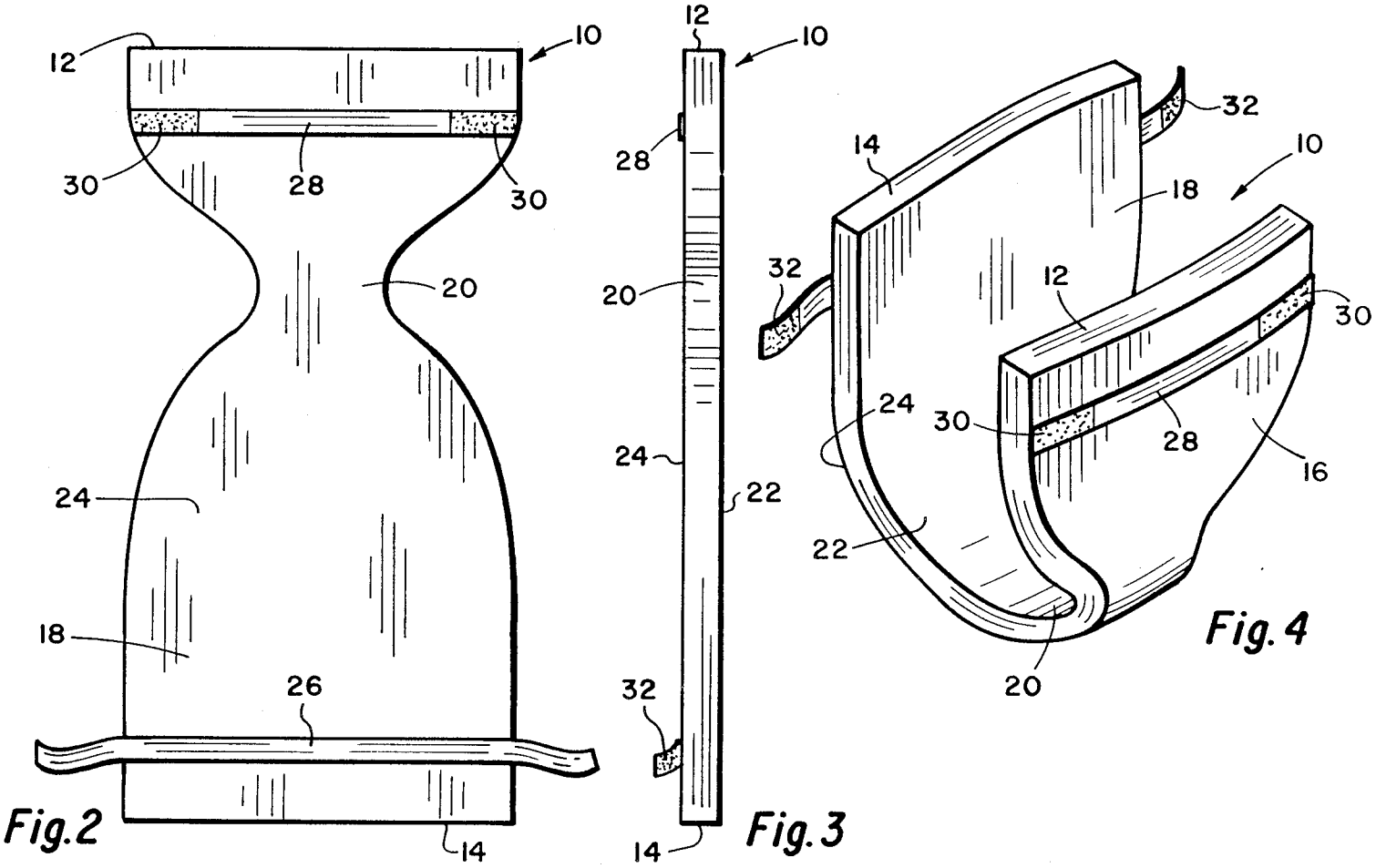
FIG. 2 is a plan view of the garment with the garment laid out in a flat manner as it would be cut from a sheet of plastic foam material and with the fastening straps thereon.
FIG. 3 is a side view of the garment in FIG. 2 in the flat position.
FIG. 4 is a view of the garment illustrated in of FIGS. 1 and 2 as it would be folded by the user in the process of placing the garment on his or her body for use.

Referring to the drawings and first to FIGS. 2 and 3, the garment of this invention is illustrated. The garment, which is indicated generally by the numeral 10, is in the form of a flat, unitary member preferably formed of closed cell plastic foam of $\frac{3}{4}$ to $1\frac{1}{2}$ inches thickness, with about 1 or $1\frac{1}{4}$ inches thickness being preferable. The garment member can be cut from a sheet of closed cell plastic foam or molded in the shape shown. The garment includes a first end 12 and an opposed second end 14. The garment is, in the flat configuration as shown in FIGS. 2 and 3, of generally non-symmetrical figure-8 construction, and has a first or front portion 16, a second or back portion 18, and an intermediate, narrow, connecting crotch portion 20 the back portion being of substantially greater area and volume than the front portion.

The garment 10 has an inner surface 22 and an opposed outer surface 24.

The garment is worn by folding it in generally U-shaped configuration as shown in FIG. 4. To retain the garment on the wearer, fastening means are provided which, in the form illustrated, includes a belt or web 26 affixed to the outer surface 24 adjacent the second end 14, and a similar second belt or web 28 which is attached to the outer surface 24 adjacent the first end 12. The webs 26 and 28 are preferably spaced adjacent to and parallel the ends 12 and 14, and include a means for attaching the webs 26 and 28 to each other. This can be accomplished as illustrated by the use of buckles, snaps or portions which can be tied together, For purposes of exemplication only and not limitation, it can also be accomplished as illustrated by means of attachment in the form of Velcro, such as wherein the Velcro cloth portion 30 is formed on or as a part of the outer ends of the second web 28, and the velcro hook portion 32 formed on or as a part of the outer ends of the first web 26.

Figure 1:
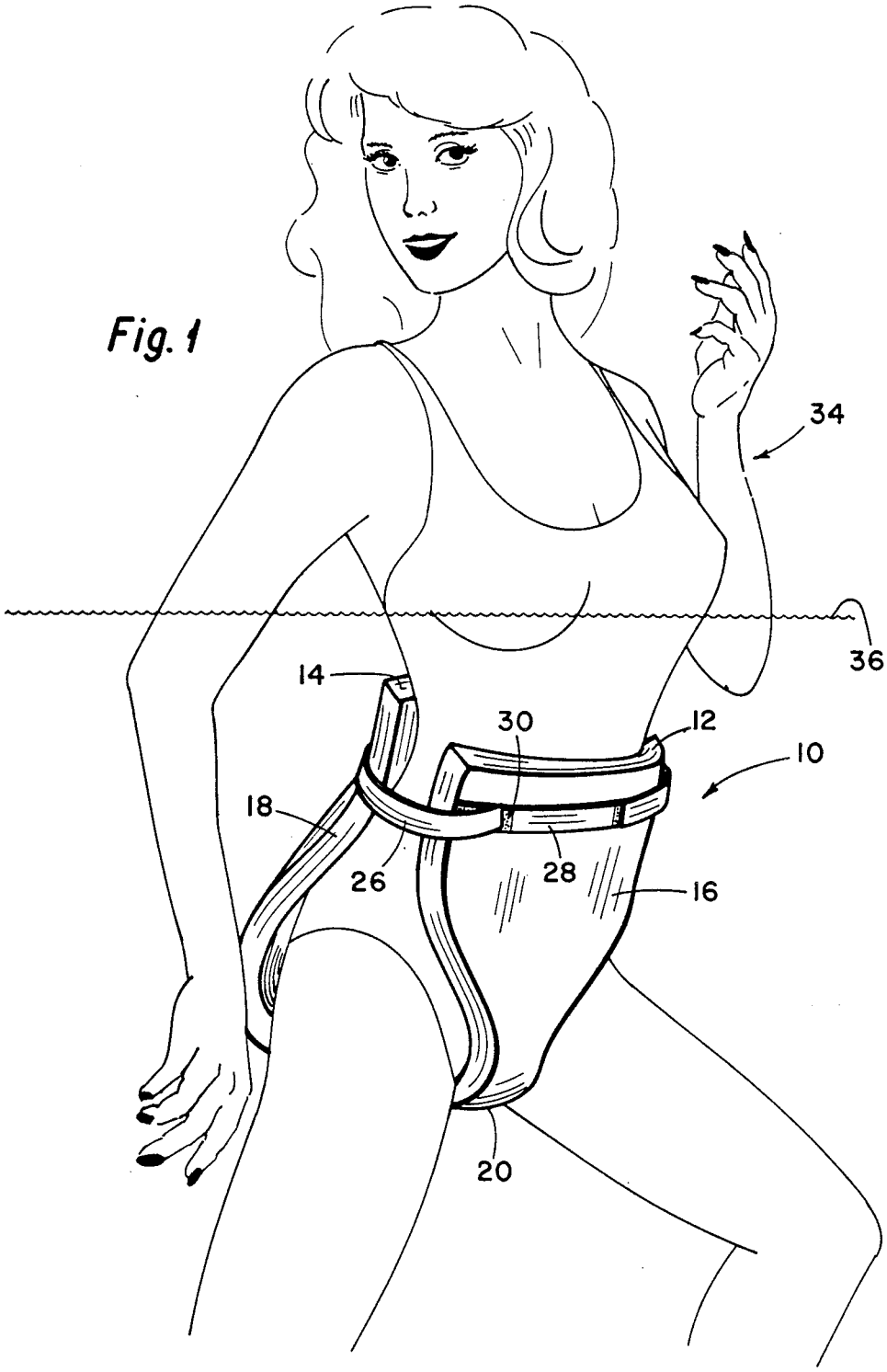
FIG. 1 is an isometric view of the garment of this disclosure as worn by a recreational swimmer, the swimmer being shown in light outline and the garment of this disclosure in darker outline.

FIG. 1 shows a user in light outline generally indicated by the numeral 34 having the garment 10 thereon. The user is shown wearing the garment within the pool of water, the surface of the water being indicated by the numeral 36. The garment is worn with the crotch portion 20 between the legs of the user, and with the inner surface 22 of the front portion 16 in engagement with the user's abdomen, and with the inner surface 22 of the back portion 18 in engagement with the user's buttocks and lower back. The webs 26 and 28 are secured together to retain the garment loosely on the wearer. The increased volume of back portion 18 compared with the front portion 16 helps float the wearer in a generally upright position as shown in FIG. 1. Further, the portion of back portion 18 which engages the user's buttocks helps maintain the user in a generally seated upright position also as shown in FIG. 1.

With the garment in position and properly sized to provide the proper amount of flotation, the wearer 34 is comfortably supported in water 36 in an upright or generally seated position. An advantage of the garment of this disclosure is that the user's legs and arms are completely free and the garment supports the user so that it is easy for the user to remain upright with the user's head comfortably out of the water and with arms free to use, such as playing water games like water polo.

The material with which the garment is made is preferably, as previously indicated, of closed cell foam plastic such as "Ensolite," a Trademark of Uniroyal Plastic Company, Inc. The thickness of the garment may preferably vary from about ¾ of an inch to 1½ inch with a thickness of about 1 to 1¼ inch being typical. Of course, the heavier the user, the thicker the material should be to provide adequate flotation for comfortable use, and, in addition, the garment is preferably in various sizes to fit not only the dimensions but the weight of the user.

The claims and the specification described the invention presented and the terms that are employed in the claims draw their meaning from the user of such terms in the specification. The same terms employed in the prior art may be broader in meaning than specifically employed herein. Whenever there is a question between the broader definition of such terms used in the prior art and the more specific use of the terms herein, the more specific means is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A garment for use in water recreation comprising:

a unitary flat member of generally non-symmetrical Figure 8 configuration having opposed first and second ends and having a first or front portion having said first end and a second or back portion having said second end, the portions being connected by a narrow or crotch portion, the member being of soft, flexible and floatable material, the back portion being of substantially greater area and volume than the front portion; and fastening means affixed to said front and back portions adjacent said first and second ends, said member being wearable by a user in which the crotch portion is positioned between the legs of the user and with said front portion in contact with the user's abdomen and said back portion in contact with the user's buttock and lower back, and retainable in said position by said fastening means and whereby the member when worn by a user serves to float the user in a generally upright or seated position.

2. A garment for use in water creation according to claim 1 wherein said member is of soft, flexible closed cell plastic foam of about ¾ to 1½ inches in thickness.

3. A garment for use in water recreation according to claim 1 wherein said fastening means is in the form of a strap affixed to said member back portion adjacent to and spaced from said second end, the opposed ends of said strap extending beyond said back portion and means to releasably connect said ends to said member front portion.

* * * * *